United States Patent [19]

Meredith

[11] Patent Number: 4,961,576

[45] Date of Patent: Oct. 9, 1990

[54] CONSTANT WALL SHAFT WITH REINFORCED TIP

[75] Inventor: Steven E. Meredith, Kennewick, Wash.

[73] Assignee: Sandvik Special Metals Corporation, Kennewick, Wash.

[21] Appl. No.: 275,578

[22] Filed: Nov. 23, 1988

[51] Int. Cl.[5] ..... A63B 53/12; A63B 59/00

[52] U.S. Cl. ..... 273/80 B; 273/72 A; 273/80 R; 72/367; 148/11.5 F

[58] Field of Search ..... 273/80 R, 80 B, 80.2, 273/80.6, 77 R, 77 A, 67 R, 72 R, 72 A; 72/367, 276, 76, 68, 70; 43/18.1; 29/DIG. 11, DIG. 41, DIG. 42; 148/11.5 F

[56] References Cited

U.S. PATENT DOCUMENTS

| | | | |
|---|---|---|---|
| 391,994 | 10/1888 | Flotow et al. | 273/80 R X |
| 1,162,960 | 12/1915 | Whyland | 72/206 |
| 1,696,698 | 12/1928 | Summer | 72/282 |
| 1,778,181 | 10/1930 | Brinkman | 273/80 R |
| 1,904,146 | 4/1933 | Larsen | 72/68 |
| 2,005,306 | 6/1935 | Wallis | 72/367 |
| 2,095,563 | 10/1937 | Cowdery | 72/276 |
| 2,240,456 | 4/1941 | Darner | 72/276 |
| 2,950,811 | 8/1960 | Kriedler | 72/76 |
| 3,292,414 | 12/1966 | Goeke | 72/367 X |
| 3,479,030 | 11/1969 | Merola | 273/80 R X |
| 3,812,702 | 5/1974 | Benteler et al. | 72/283 |
| 3,841,130 | 10/1974 | Scott et al. | 72/70 |
| 3,854,316 | 12/1974 | Wilson | 72/76 |
| 3,969,155 | 7/1976 | McKeighen | 72/364 X |
| 4,157,654 | 6/1979 | Kahlow et al. | 72/367 |
| 4,169,595 | 10/1979 | Kaugars | 273/80 R |
| 4,298,155 | 11/1981 | Palovcik | 72/367 |
| 4,498,321 | 3/1985 | Yoshida | 72/76 |
| 4,512,069 | 4/1985 | Hagemeister | 72/367 X |
| 4,523,445 | 6/1985 | Yoshida | 72/69 |
| 4,616,500 | 10/1986 | Alexoff | 72/283 |
| 4,622,841 | 11/1986 | Yoshida | 72/367 |
| 4,625,537 | 12/1986 | Aleck | 72/367 |
| 4,722,216 | 2/1988 | Fencl | 72/367 X |

FOREIGN PATENT DOCUMENTS

| | | | |
|---|---|---|---|
| 1246539 | 8/1971 | United Kingdom | 273/80 B |

OTHER PUBLICATIONS

*Titanalloy,* "Golf World", Jan. 24, 1975, p. 26.

*Primary Examiner*—William H. Grieb
*Assistant Examiner*—Sebastiano Passaniti
*Attorney, Agent, or Firm*—Burns, Doane, Swecker & Mathis

[57] ABSTRACT

A hollow metallic shaft for sporting implements includes a cylindrical tip section having a first constant wall thickness, a shank section including a tapered portion and having a second constant wall thickness, and a cylindrical portion located adjacent the tapered portion and opposite the tip section. An increase in wall thickness provides additional reinforcement at the tip section. The method of making the shaft includes an initial rotary swaging of an end portion of the shaft followed by a series of sink drawing operations to form a stepped contour on the outer periphery of the shaft. A final rotary swaging of the stepped contour provides the shaft with a smooth taper towards one end.

14 Claims, 3 Drawing Sheets

CONSTANT WALL SHAFT WITH REINFORCED TIP

BACKGROUND OF THE INVENTION

This invention relates to a method for making improved tubular metallic shafts for golf clubs and other sporting implements.

As is commonly known, a golf shaft undergoes a significant stress during a golf swing at the portion of the shaft where the club head is attached. Typically, this portion of the shaft is of the narrowest diameter with respect to the remainder of the shaft since most golf shafts have a tapered configuration. Thus, this portion is especially susceptible to deformation if excessive force is used in hitting a golf ball or, in the alternative, a mis-hit occurs and the club head hits the ground.

The most convenient way of eliminating such a problem area on the shaft would be to increase its diameter to a value closer to the diameter of the rest of the shaft. Such a remedy is highly undesirable, however, because the weight distribution and moment of inertia inherent in a narrowing diameter or tapering shaft is necessary for execution of the most effective golf swing. More particularly, a tapered shaft is necessary in order to provide the proper "flex" and "flex point" of the shaft for an effective stroke. Both the "flex" and the "flex point" are determined according to the tapering nature of the shaft.

Consequently, various tip configurations have been used to reinforce this segment of the shaft while retaining its narrowing characteristic, the most common perhaps being the incorporation of a reinforcing metal insert. Such an insert, however, adds undesired weight to the shaft and also necessitates some kind of retaining feature to hold it in place. Such a retaining feature may include the use of a retaining pin or a special mechanical joining operation.

Methods for making shafts with varying wall thickness are contemplated in the prior art. For example, U.S. Pat. No. 2,095,563 to Cowdery discloses a method of making a golf shaft wherein a tip portion has a wall thickness larger than that of the remaining portion of the shaft. However, the increased wall thickness is achieved by an operation which usually fails to give a constant wall thickness along the shank portion of the shaft thus adversely affecting weight distribution.

U.S. Pat. No. 2,240,456 to Darner and U.S. Pat. No. 4,616,500 to Alexoff show methods for providing varying wall thickness on a shaft with a constant outer diameter.

U.S. Pat. No. 3,292,414 to Goeke shows a method that provides a shaft with a tapered end, the tapered end having internal corrugations for strenghthening.

U.S. Pat. No. 3,841,130 to Scott, Jr. et al. shows a baseball bat with a tapered, constant-thickness wall.

OBJECTS AND SUMMARY OF THE INVENTION

An object of the invention is to provide a method for making a shaft that solves the problems enumerated above.

A further object of the invention is to provide a shaft having a reinforced tip portion due to increased wall thickness.

A further object of the invention is to provide a shaft having constant wall thickness over at least a tapered shank portion of a shaft.

The objects are achieved according to the invention which involves a method of making a shaft, e.g. a golf shaft, comprising the steps of: including the steps of rotary swaging a first end portion of a metal shaft from a first outer diameter to a second, smaller outer diameter and increased wall thickness; sink drawing a second portion of the metal shaft located adjacent the end portion through at least four draw passes of decreasing die diameter to form a series of steps of progressively increasing outer diameter in a direction away from the end portion; and, rotary swaging the stepped second portion to form a smooth taper on the outer diameter of the shaft, which taper narrows toward the end portion.

The invention also contemplates a shaft, e.g. a golf shaft, for sporting implements including a cylindrical tip section at least a substantial portion of which having a first constant wall thickness. The metal shaft may also include a shank section having a tapered portion wherein the tapered portion has a smooth peripheral tapered outer diameter which narrows toward the cylindrical tip section. The tapered portion has a second constant wall thickness and the tapered portion terminates at the cylindrical tip section. An outer diameter of the cylindrical tip section is no larger than a smallest outer diameter of the tapered portion. The first constant wall thickness is greater than the second constant wall thickness.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF THE PREFERRED EMBODIMENT

Figure 1:
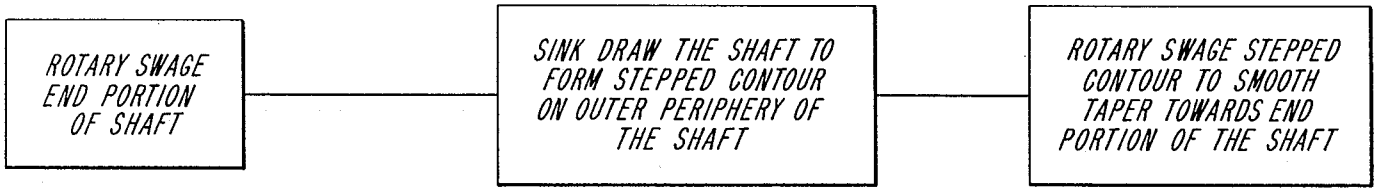
FIG. 1 shows a block diagram including the steps needed to perform the present invention.

With reference now to the drawings, and especially FIG. 1, the various stages of forming a metal shaft are shown.

Figure 2A:
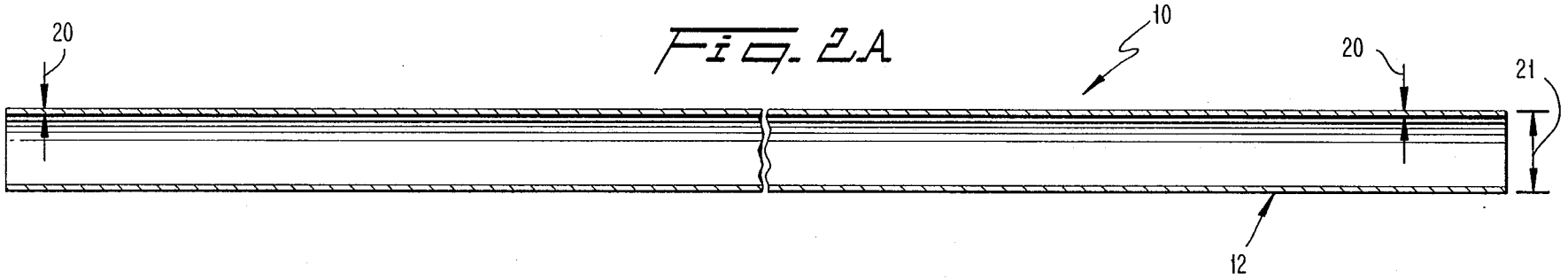
FIGS. 2A–2D shows a shaft during various stages of fabrication.
Figure 2B:
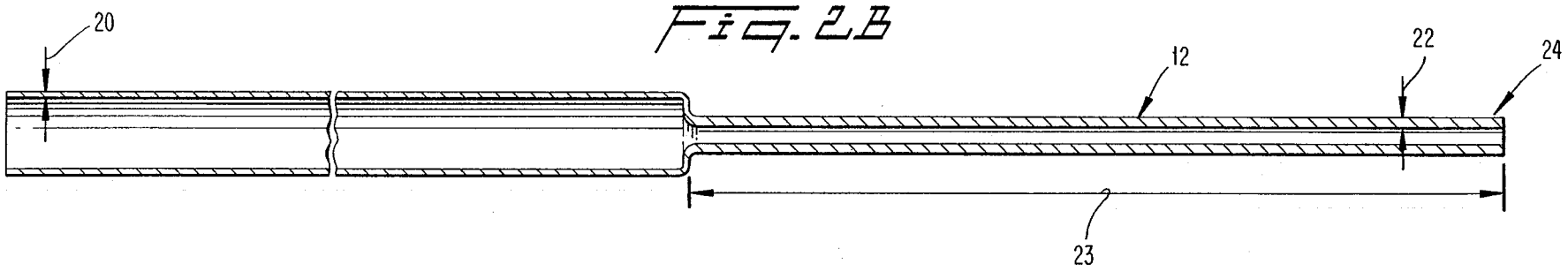

Initially, a metal shaft 10 is provided which has a substantially constant wall thickness 20 and a substantially constant outer diameter 21 over its entire length (see FIG. 2A). For a shaft made from titanium alloy and intended for use as a golf club shaft, the outer diameter 21 is preferably about 0.5945", the wall thickness 20 is preferably about 0.0235" and the length is preferably around 42 inches. In the first step, the shaft is subjected to a conventional rotary swaging operation so that the wall thickness 22 at one end 12 along a certain length 23, e.g., about 6 inches, is increased with respect to the wall thickness 20 on the remainder of the shaft (see FIG. 2B). As a result, a cylindrical tip portion 24 is formed that serves at least two purposes. First, a clamping surface is provided to which a drawing tool can be attached for performing draw passes as discussed below. Second, the shaft now has a portion that is strengthened with respect to the remainder of the shaft due to the increased wall thickness which is highly desirable in certain uses for shafts, e.g. use in a golf club.

Figure 2C:
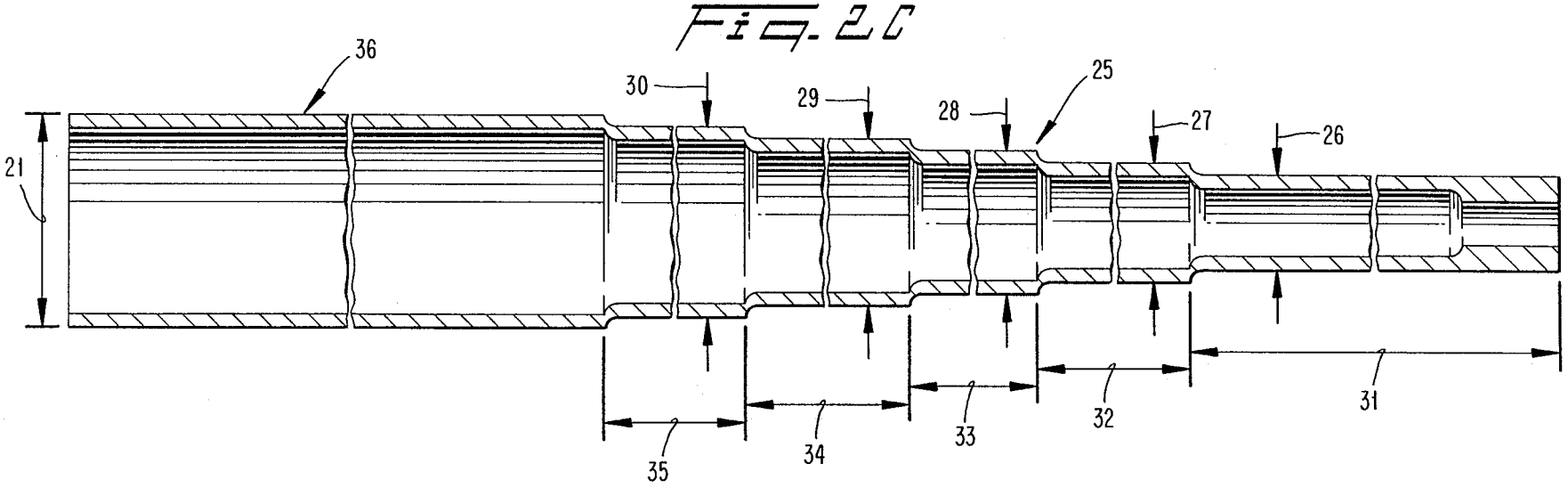

In the next series of steps of FIG. 1, a drawing tool (not shown) is clamped to the swaged end 24 of the shaft in a conventional manner and sink drawing is performed on a shank portion 25 of the metal shaft adjacent the swaged portion 24. The sink drawing includes several draw passes and each successive draw uses a draw die having a smaller diameter than that of the draw die used in the immediately preceding draw. The successive draws form a stepped contour on the outer periphery of the metal shaft having steps of increasing outer diameters 26–30 and axial lengths 31–35 as shown in FIG. 2C. The step with the smallest diameter 26 includes that portion 24 of the shaft that was initially swaged. The outer diameters 26–30 and the axial lengths 31–35 will vary according to desired "flex" and "flex points" for a particular shaft. It should be noted that one draw step can include the simultaneous use of two dies (of different diameter) and thus reduce the number of draws required while yet still providing the desired number of steps. Preferably, for golf club shafts made from titanium alloy and designed to have a midway "flex point", the outer diameters of each of the steps 26–30 are about 0.375", 0.420", 0.460", 0.507" and 0.552", respectively, while the axial lengths 31–35 of steps 26–30 are 7.50", 4.5", 4.0", 4.75" and 4.25", respectively. The undrawn and unswaged portion 36 of the shaft remains at the shank portion of the original shaft diameter 21.

Since the steps are formed through a sink drawing operation, i.e., drawing without an internal mandrel, the wall thickness of the shaft at each step portion 26–30 remains substantially the same as it was before drawing (wall thickness remains substantially the same in the undrawn portion 36 as well). The drawing operation will, however, slightly increase the length of the shaft beyond its initial length due to the cold flow of the metal.

Figure 2D:
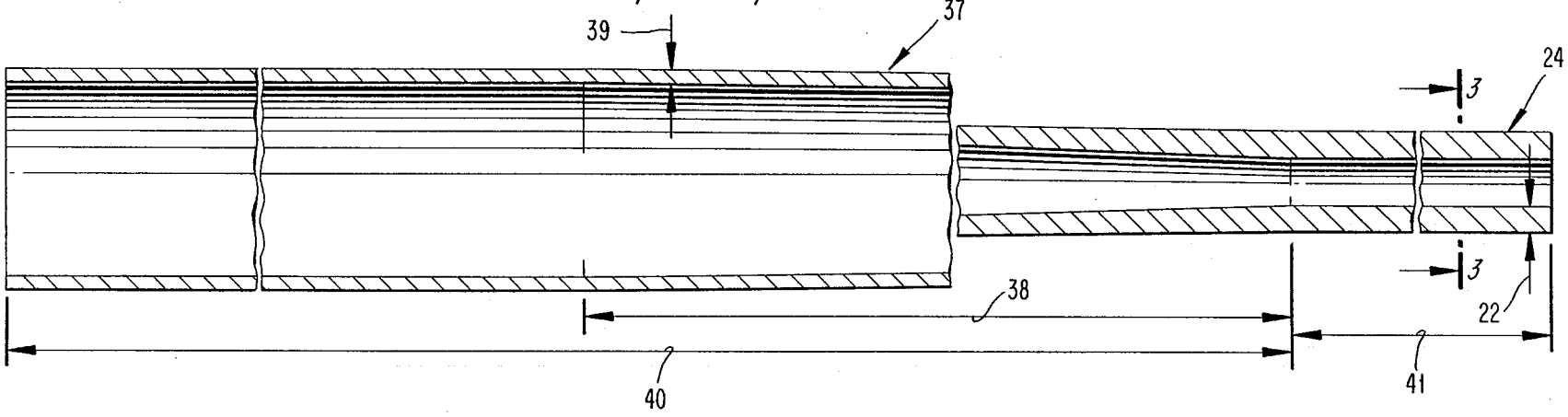

After all of the drawing steps are completed, the metal shaft is again subjected to a conventional rotary swaging operation, this time performed on the stepped portion 25 of the shank portion of the shaft to remove the steps 26–30 created in the sink drawing operation and thus form a smooth taper 37 over that length of the shaft as shown in FIG. 2D. The swaging operation also serves to blend the taper 37 with the end of the shaft 24 that was rotary swaged to a cylindrical shape in the first step. The rotary swaging operation may require two or three passes and generally will be performed using long swaging dies as are known in the art. For a titanium alloy shaft, the length of the taper 38 is preferably around 25.8" which would require two or three swaging operations using conventional 12"–15" swaging dies.

After rotary swaging the steps, the segment of the cylindrical tip portion 24 of the shaft that has served as a clamping surface for the drawing tool is cut-off. The forces exerted on the metal on that segment will have caused scuffing and pitting thus rendering an unusable surface. It should be noted that only that segment effected by the clamped tool is removed and not the entire tip portion. Thus, a swaged cylindrical portion 24 of increased wall thickness 22 remains at the end of the shaft.

The shaft resulting from this method thus has a wall of substantially constant thickness 39 along length 40 of a shank portion the shaft. Preferably, for a golf club shaft of titanium alloy, this thickness is about 0.023" over a length of about 37.9". For the remaining end portion 41 of the shaft as seen in FIG. 2D, the thickness 22 remains substantially greater than the thickness of the rest of the shaft, this being due to the initial swaging operation. The length 41 of this portion of increased thickness 24 is preferably about 7". This thickness 22 is constant along a substantial portion of length 41 and is preferably about 0.040" maximum. As a result, the end product is a shaft having a wall of constant thickness over a shank portion of the shaft and a wall of increased thickness at the cylindrical tip of the shaft where a golf club head is attached. Accordingly, no further reinforcement, for example, by a reinforcing insert, is necessary.

It should be noted that as a final step, the shaft may undergo a heat treatment process wherein one of the results is a growth in the outer diameter of the shaft. In a golf shaft of titanium alloy wherein the outer diameter was initially 0.5945", the outer diameter after heat treatment will have increased to about 0.600" which is the industry standard for golf shafts.

The metal that is particularly suited for this method of making a golf shaft is seamless titanium or titanium alloy (e.g., Ti-3A1-2.5V) tubing although other metal alloys are also acceptable. Welded tubing is not recommended since the weld could crack during swaging.

Figure 4:
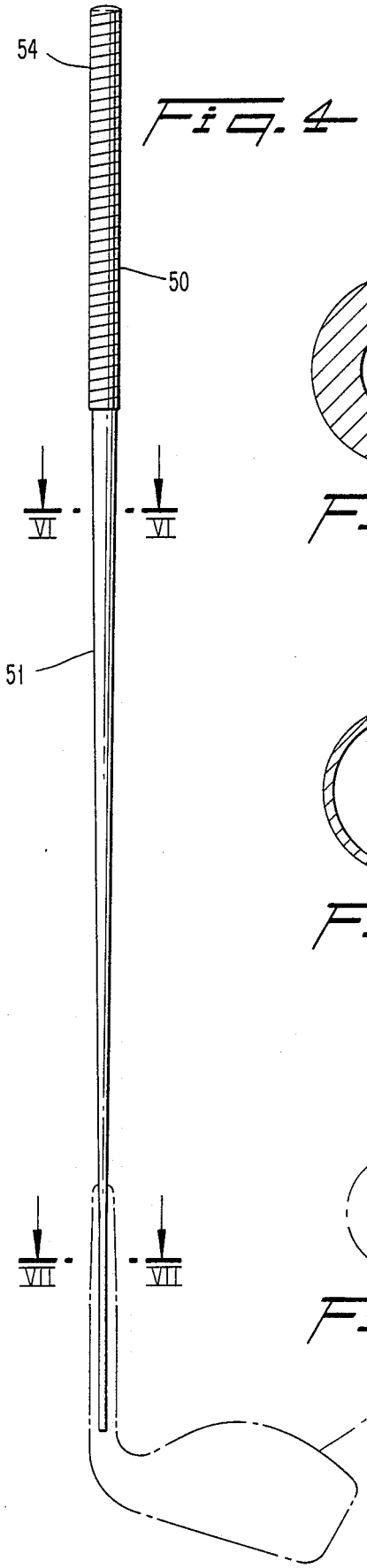
FIG. 4 shows an embodiment of the present invention in use as a shaft for a golf club wood.
Figure 3:
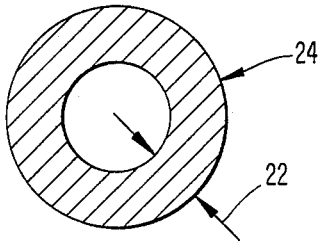
FIG. 3 shows a cross-section of a tip portion of a shaft as depicted in FIG. 2D.
Figure 5:
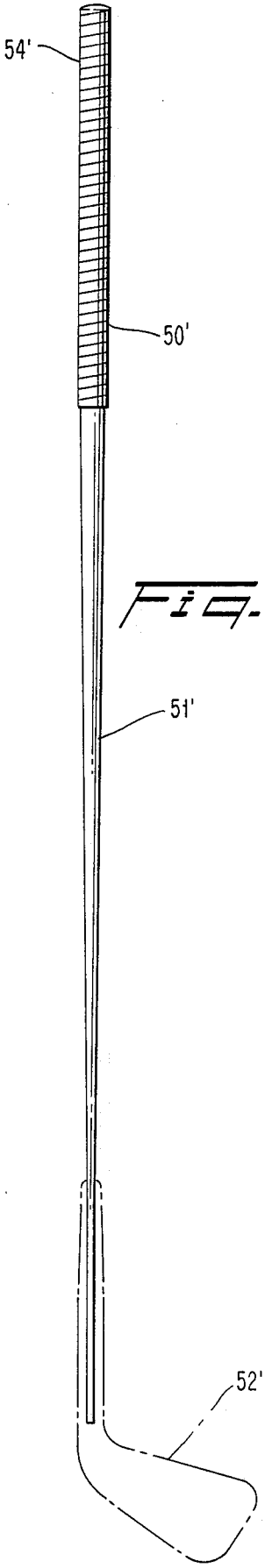
FIG. 5 shows an embodiment of the present invention in use as a shaft for a golf club iron.

This method is particularly adapted for making club irons or club woods as is shown in FIGS. 4 and 5. The golf club includes a handle portion 50 or 50', a shank portion 51 or 51' and a striking portion 52 or 52' (wood or iron, respectively). The handle portion 50 or 50' includes a wrapping 54 or 54' for easier gripping. The handle portion 50 or 50' and shank portion 51 or 51' is formed of the shaft formed as in FIG. 2D with the shank portion 51 or 51' being connected to the appropriate striking potion 52 or 52' by an epoxy resin as is known in the art. For making woods, it is preferable to use five draw steps while for making irons it is preferable to use four draw steps. The additional draw step for making woods is necessary since woods typically require a smaller tip diameter than do irons. To aid in the final swaging operation that forms the smooth taper, it is encouraged that as many draws are performed as possible.

Figure 6:
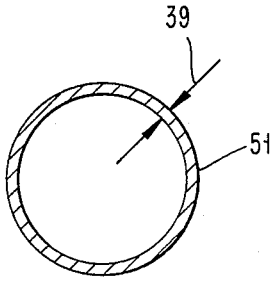
FIG. 6 shows a cross-sectional view of the present invention along the lines VI—VI of FIG. 4.
Figure 7:
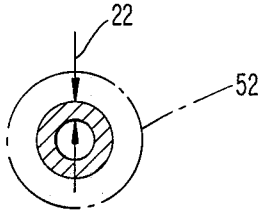
FIG. 7 shows a cross-sectional view of the present invention along the lines VII—VII of FIG. 4.

A shown in FIG. 6, the shank section 51 of the golf club of FIG. 4 has a wall thickness 39. Similarly, as shown in FIG. 7, a tip section of the golf club has a wall thickness 22. As described with regard to FIG. 2D, the wall thickness 22 at the tip section is greater than the wall thickness 39 of the shank section. A similar configuration is used with the golf club iron of FIG. 5.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in claims be embraced thereby.

We claim:

1. A method of making a shaft for sporting implements which comprises the steps of:

rotary swaging a first end portion of a metal shaft from a first outer diameter to a second, smaller outer diameter and increased wall thickness, sink drawing a second portion of said metal shaft located adjacent said end portion through at least four draw passes of decreasing die diameter to form a series of steps of progressively increasing outer diameter in a direction away from said end portion, and, rotary swaging said stepped second portion to form a smooth taper on said outer diameter of said shaft, which taper narrows toward said end portion.

2. A method of making a shaft for sporting implements according to claim 1, wherein said rotary swaging of said first end portion is performed on a metal shaft comprised of seamless titanium alloy tubing.

3. A method of making a shaft according to claim 1, wherein said sink drawing of said metal shaft comprises four draws.

4. A methods of making a shaft according to claim 1, wherein said sink drawing of said metal shaft comprises five draws.

5. A hollow metal shaft for sporting implements comprising:

a cylindrical tip section at least a substantial portion of which having a first constant wall thickness, said substantial portion located generally towards a first end portion of said shaft, a shank section including a tapered portion having a smooth peripheral tapered outer diameter which narrows toward said cylindrical tip section, said tapered portion having a second constant wall thickness, said tapered portion terminating at said cylindrical tip section, an outer diameter of said cylindrical tip section being no larger than a smallest outer diameter of said tapered portion, said first constant wall thickness being greater than said second constant wall thickness.

6. A metal shaft for supporting implements according to claim 5, said metal shaft being seamless titanium alloy tubing.

7. In a golf club having a handle portion, a shank portion and a striking portion, the improvement which comprises using as the handle portion and shank portion, the metal shaft of claim 5.

8. A method of making a golf club which includes a shaft and a club head, comprising the steps of rotary swaging a first end portion of a metal shaft from a first outer diameter to a second, smaller outer diameter and increased wall thickness, sink drawing a second portion of said metal shaft located adjacent said end portion through at least four draw passes of decreasing die diameter to form a series of steps of progressively increasing outer diameter in a direction away from said end portion, and, rotary swaging said stepped second portion to form a smooth taper on said outer diameter of said shaft, which taper narrows toward said end portion for fixedly attaching a club head to said end portion.

9. A golf club which includes a hollow metal shaft, a handle portion, and a striking portion, said shaft comprising:

a cylindrical tip section at least a substantial portion of which having a first constant wall thickness, said substantial portion located generally towards a first end portion of said shaft for fixedly attaching said striking portion to said end portion, a shank section including a tapered portion having a smooth peripheral tapered outer diameter which narrows toward said cylindrical tip section, said tapered portion having a second constant wall thickness, said tapered portion terminating at said cylindrical tip section, an outer diameter of said cylindrical tip section being no larger than a smallest outer diameter of said tapered portion, said first constant wall thickness being greater than said second constant wall thickness.

10. A metal shaft for sporting implements as set forth in claim 5, the shank section further including a cylindrical portion located adjacent said tapered portion opposite said tip section, said cylindrical portion having an outer diameter at least as large as a largest outer diameter of said tapered portion.

11. A golf club as set forth in claim 9, the shank section further including a cylindrical portion located adjacent said tapered portion opposite said tip section, said cylindrical portion having an outer diameter at least as large as a largest outer diameter of said tapered portion.

12. A golf club according to claim 9, said shaft being seamless titanium alloy tubing.

13. A metal shaft for sporting implements formed from a cylindrical workpiece having an initial constant wall thickness comprising:

a tip section formed by swaging, at least a substantial portion of said tip section having a first constant wall thickness larger than said initial constant wall thickness of said cylindrical workpiece, said substantial portion located generally towards a first end portion of said shaft, a shank section having a tapered portion formed by sink drawing and subsequent swaging, said tapered portion having a smooth peripheral tapered outer diameter which narrows toward said tip section, said tapered portion having a second constant wall thickness, said tapered portion terminating at said tip section, an outer diameter of said tip section being no larger than a smallest outer diameter of said tapered portion, and said first constant wall thickness being greater than said second constant wall thickness.

14. A metal shaft for sporting implements as set forth in claim 13, the shank section further including a cylindrical portion located adjacent said tapered portion opposite said tip section, said cylindrical portion having an outer diameter at least as large as a largest outer diameter of said tapered portion.

* * * * *